US008475179B2

(12) United States Patent
Lin et al.

(10) Patent No.: US 8,475,179 B2
(45) Date of Patent: Jul. 2, 2013

(54) ELECTRICAL CONNECTOR CAPABLE OF INTERCONNECTING ELECTRONIC DEVICES HAVING DIFFERENT CONDUCTIVE LEADS ARRANGEMENTS

(75) Inventors: Nan-Hung Lin, Tu-Cheng (TW); Chih-Pi Cheng, Tu-Cheng (TW); Jia-Hau Liu, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 277 days.

(21) Appl. No.: 12/983,829

(22) Filed: Jan. 3, 2011

(65) Prior Publication Data

US 2011/0159737 A1 Jun. 30, 2011

(51) Int. Cl.
*H01R 12/00* (2006.01)

(52) U.S. Cl.
USPC ..... 439/66; 439/862

(58) Field of Classification Search
USPC ..... 439/66, 862, 71
See application file for complete search history.

(56) References Cited

U.S. PATENT DOCUMENTS

| | | | | |
|---|---|---|---|---|
| 4,887,974 | A * | 12/1989 | Ichimura et al. | 439/259 |
| 6,061,819 | A * | 5/2000 | Bening et al. | 714/741 |
| 6,083,022 | A * | 7/2000 | Walkup | 439/260 |
| 6,332,782 | B1 * | 12/2001 | Bezama et al. | 439/66 |
| 6,814,586 | B1 * | 11/2004 | Ju | 439/66 |
| 6,981,881 | B2 * | 1/2006 | Adachi et al. | 439/71 |
| 7,044,746 | B2 | 5/2006 | Copper et al. | |

FOREIGN PATENT DOCUMENTS

TW M365569 9/2009

* cited by examiner

*Primary Examiner* — Xuong Chung Trans
(74) *Attorney, Agent, or Firm* — Wei Te Chung; Ming Chieh Chang

(57) ABSTRACT

An electrical connector includes an upper housing formed with a plurality of upper through holes therein, and a lower housing located under the upper housing and formed with a plurality of lower through holes therein corresponding to the upper through holes, respectively. A plurality of contacts are received within the upper housing and the lower housing, and respectively has an upper contacting portion and a lower contacting portion. At least some of the contacts extend with angles of inclination varying in sequence so that a distance defined by two neighboring lower contacting portions is larger than that defined by corresponding two neighboring upper contacting portions.

20 Claims, 4 Drawing Sheets

ELECTRICAL CONNECTOR CAPABLE OF INTERCONNECTING ELECTRONIC DEVICES HAVING DIFFERENT CONDUCTIVE LEADS ARRANGEMENTS

BACKGROUND OF THE INVENTION

1. Field of the Invention

The present invention relates to an electrical connector, and more particularly to an electrical connector equipped with improved contacts for interconnecting an IC (Integrated Circuit) package and a PCB (Printed Circuit Board) which have different conductive leads arrangement.

2. Description of Related Art

U.S. Pat. No. 7,044,746 issued to Copper et al., on May 16, 2006 disclosed an electrical connector mounted on a PCB for receiving and connecting an IC package. The electrical connector includes an insulative housing with a plurality of contacts received therein. The contacts are arranged in a matrix of high density, and each contact has two ends respectively contact with a conductive lead or pad of the IC package and another conductive pad on the PCB, so that the electrical connection between the IC package and the PCB is achieved. As a higher desire for the performance of the IC package, the number of the pads of the IC package and the contacts of the electrical connector are increased. However, as the number of the contacts of the electrical connector is increased, the risk of short circuit of neighboring contacts is subsequently increased when soldered onto the conductive pads of the PCB.

To overcome the above problem, Taiwanese Patent No. M365569 discloses an improved connector in which a plurality of contacts are also arranged in a matrix. Each contact has a slantwise neck above a low contact portion which is to be soldered on a PCB. The angles of the necks relative to an imaginary plumb line vary in sequence. For details, the necks at the opposite ends have biggest angles relative to the plumb line, and the part near the middle of connector tend to be vertical, so that the lower contact portions are uniformly arranged, while the distance between any two neighboring lower contact portions is larger than the distance between corresponding two neighboring upper contact portions of the contacts. However, because of the multiple different contact structures, the production of the contacts is complicated and the cost thereof is increased. In addition, because the contact have to be inserted to housing row by row, the assembling of the connector is inefficient.

In view of the above, an improved fine-pitch electrical connector is desired.

SUMMARY OF THE INVENTION

Accordingly, an object of the present invention is to provide an fine-pitch electrical connector configured to enlarge the pitch between lower contacting portions of contacts therein and is thus adapted to be reliably mounted to a Printed circuit board.

According to one aspect of the present invention, there is provided an electrical connector which includes an upper housing formed with a plurality of upper through holes therein, and a lower housing located under the upper housing and formed with a plurality of lower through holes therein corresponding to the upper through holes, respectively. A plurality of contacts are received within the upper housing and the lower housing, and respectively has an upper contacting portion and a lower contacting portion. At least some of the contacts extend with angles of inclination varying in sequence so that a distance defined by two neighboring lower contacting portions is larger than that defined by corresponding two neighboring upper contacting portions.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
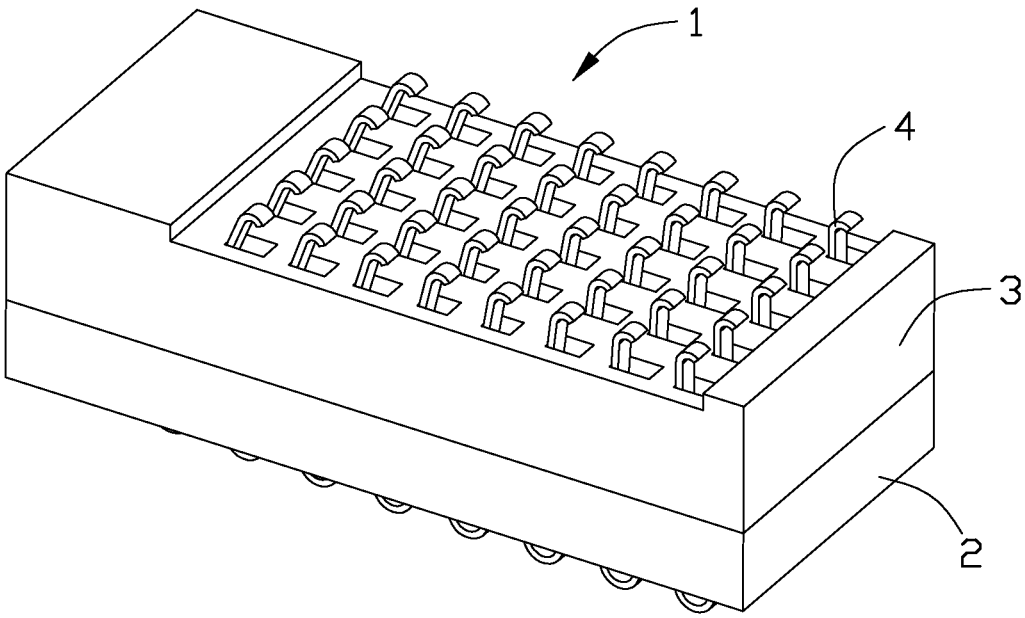
FIG. 1 is an assembled perspective view of an electrical connector in accordance with a preferred embodiment of the present invention.
Figure 2:
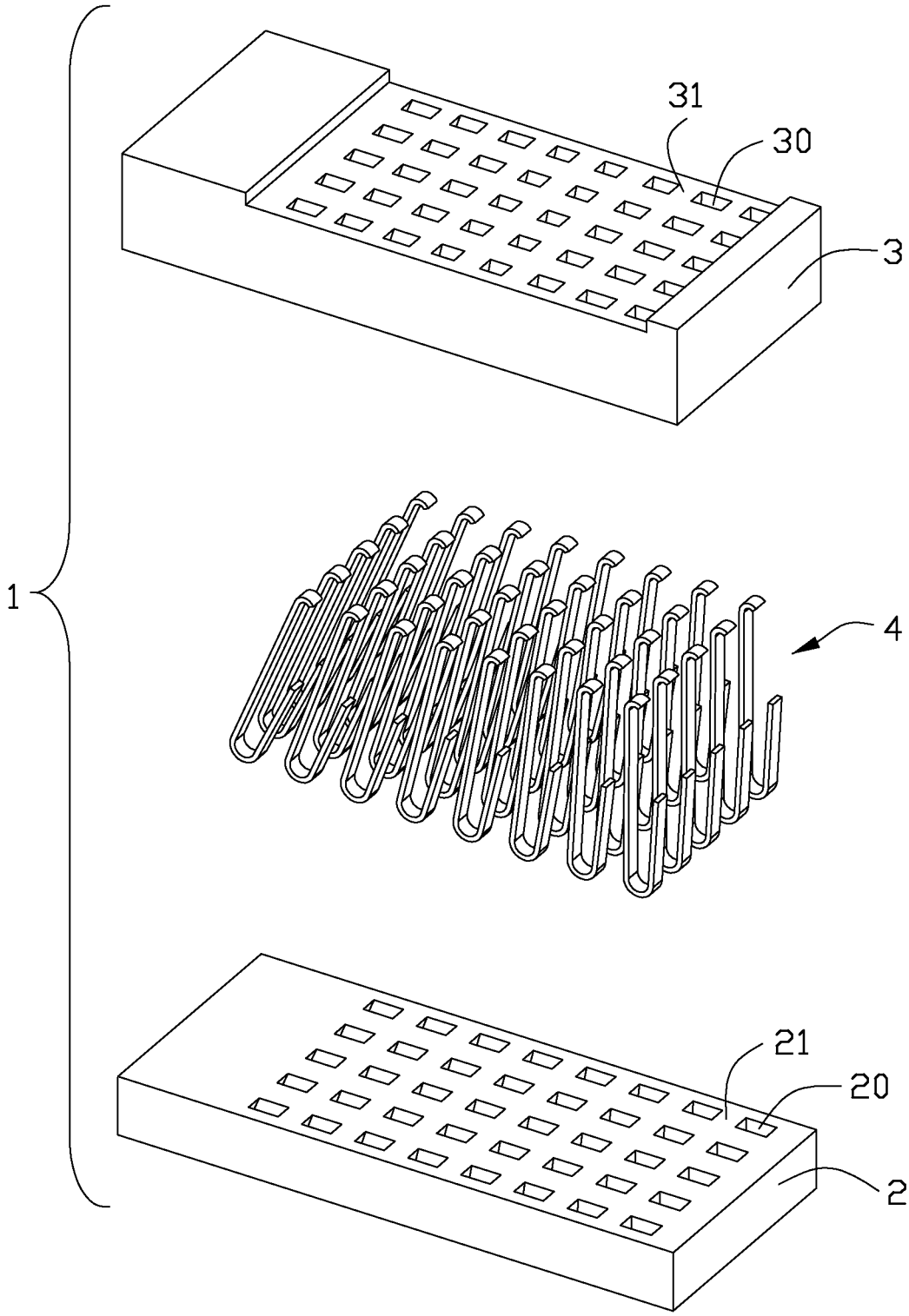
FIG. 2 is an exploded perspective view of the electrical connector shown in FIG. 1.

FIG. 1 and FIG. 2 respectively demonstrate an assembled structure and an exploded structure of an electrical connector 1 made in accordance to a preferable embodiment of the present invention. The electrical connector 1 is generally used to interconnect two electronic devices, for example, a PCB and an IC package (not shown), both in a manner of LGA (Land Grid Array).

Figure 3:
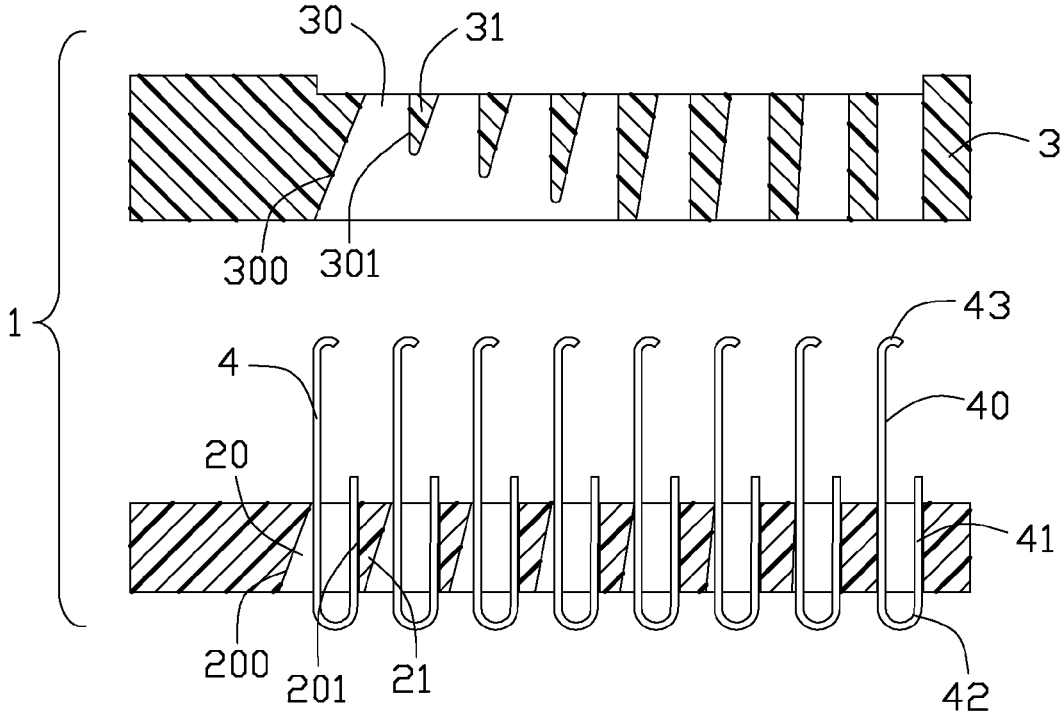
FIG. 3 is an exploded side-view of the electrical connector as shown in FIG. 1.
Figure 4:
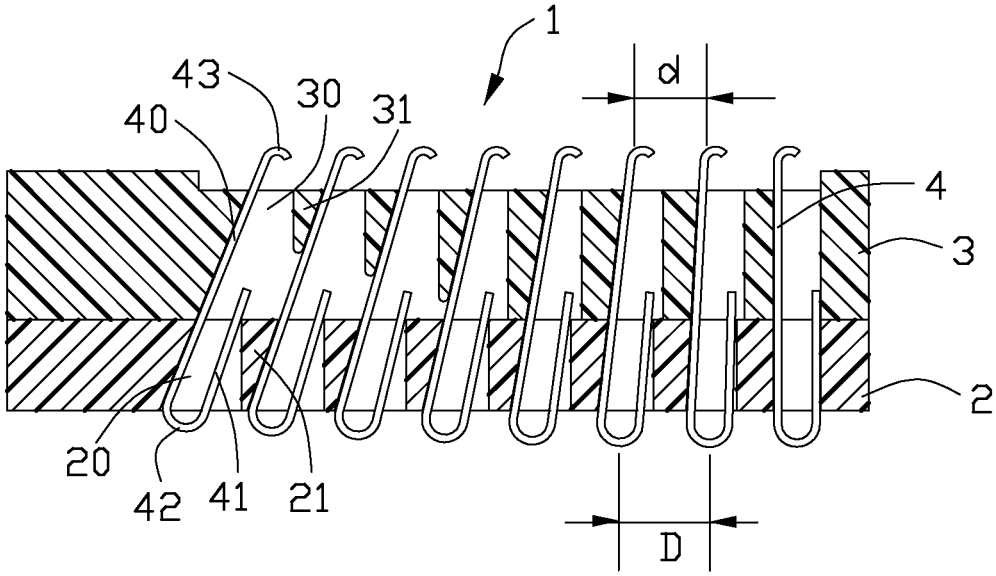
FIG. 4 is an assembled side-view of the electrical connector as shown in FIG. 1.

The electrical connector 1 primarily includes an upper housing 3, a lower housing 2 located under the upper housing 2, and a plurality of contacts 4 respectively received within the upper housing 3 and the lower housing 2. Particularly referring to FIG. 2 and FIG. 3, the upper housing 3 defines a plurality of upper through holes 30, and the lower housing 2 defines a plurality of lower through holes 20. An upper through hole 30 and a corresponding lower through hole 20 jointly constitute a passage (not labeled) for receiving the contact 4. Each upper through hole 30 defines an upper abutting surface 300 and an upper vertical surface 301. The upper abutting surfaces 300 slant with angles of inclination varying in sequence along a direction of the arrangement of the contacts 4. Between two neighboring upper through holes 30 is an upper partition wall 31, which provides the upper abutting surface 300 and the upper vertical surface 301, except the most-side ones. Some of the upper partition walls 31 are shorter than those of others and don't reach a bottom surface (not labeled) of the upper housing 3. Similarly, the lower through hole 20 defines a lower abutting surface 200 and a lower vertical surface 201. The lower abutting surfaces 200 also slant with angles of inclination varying in sequence along the direction of the arrangement of the contacts 4. Between two neighboring lower through holes 20 is a lower partition wall 21, which provides the lower abutting surface 200 and the lower vertical surface 201, except the most-side ones. When the upper housing 3 and the lower housing 2 are assembled together, the upper abutting surface 300 is coplanar with corresponding lower abutting surface 200.

The contact 4 includes an elastic arm 40 and a supporting arm 41 bended upwardly from the lower contacting portion. The opposite ends of the elastic arm 40 are respectively formed with an upper contacting portion 43 extending beyond an upper top of the upper housing 3 and a lower contacting portion 42 extending beyond a bottom surface of the lower housing 2.

Following is the description of the assembling process of the electrical connector 1. Particularly referring to FIG. 3, the contacts 4 are firstly inserted to and received in the lower through holes 20 of the lower housing 2. The parallel lower vertical surfaces 201 engage the supporting arm 41 of the contacts 4 and thus have the contacts 4 be placed in vertical direction and arranged in parallel to one another. So the lower vertical surface 201 of the lower housing 2 should also be regarded as a positioning surface in view of its special function. The upper housing 3 preliminarily aligned with the lower housing 2 is then moved downwardly and mounted upon the lower housing 2. During this process, the unparallel upper abutting surfaces 300 engage the elastic arms 40 of the contacts 4 and thus have the contacts 4 finally slant with different angles of inclination which vary in sequence along the direction of the contacts 4 arrangement. So the upper abutting surface 300 of the upper housing 3 should also be regarded as a guiding surface in view of its special function. After the assembling is completed, the elastic arm 40 of each contact 4 abuts against the upper abutting surface 300 and the lower abutting surface 301, and the supporting arm abuts against the lower vertical surface 201. The contacts 4 are respectively disposed at different angles relative to an imaginary horizontal plane, wherein the contact 4 that located at a most-side end is vertical to the horizontal plane. The lower contacting portions 42 of all the contacts 4 form a uniform arrangement of matrix with any neighboring lower contacting portions 42 defining a distance D therebetween. Similarly, the upper contacting portions 43 of the contacts 4 form another uniform arrangement of matrix with any neighboring upper contacting portions 43 defines a distance d therebetween. According to forgoing description of the structure of the housing assembly, it is easy to understand that the distance D is larger than the distance d, which is suitable to be used between an IC package of fine-pitch and a PCB where larger tolerance of circuit short is desired.

In addition, all the contacts 4 of the present invention should be mounted into the lower housing 2 at the same time and are then automatically adjusted to reach respective angle of inclination by the upper housing 3. Another advantage of the present invention is that the linear contacts 4 are easy to be manufactured, without multiple units of tools, compared with conventional arts that tend to achieve some function as the present invention. Cost thereof is thus reduced.

While preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector, comprising:

an upper housing formed with a plurality of upper through holes therein;

a lower housing located under the upper housing and formed with a plurality of lower through holes therein corresponding to the upper through holes, respectively; and a plurality of contacts each received within the upper housing and the lower housing, and respectively having an upper contacting portion and a lower contacting portion, wherein top ends of some of the lower through holes are smaller than those of corresponding bottom ends, the contacts are set in said through holes first in a vertical direction and parallel with each other, then be pressed to extend with angles of inclination varying in sequence so that a distance defined by two neighboring lower contacting portions is larger than that defined by corresponding two neighboring upper contacting portions.

2. The electrical connector as claimed in claim 1, wherein the lower contacting portions are uniformly arranged with equal distances between any two neighboring lower contacting portions.

3. The electrical connector as claimed in claim 1, wherein at least one of the contacts is vertical with respect to the upper and the lower housing.

4. The electrical connector as claimed in claim 1, wherein the contact comprises an elastic arm with said upper contacting portion and lower contacting portion formed at two opposite ends thereof, and a supporting arm bended upwardly from the lower contacting portion.

5. The electrical connector as claimed in claim 4, wherein the upper and lower contacting portions of the contact respectively extend beyond a top surface of the upper hosing and a bottom surface of the lower housing.

6. The electrical connector as claimed in claim 4, wherein the lower housing has plurality of lower partition walls between neighboring lower through holes, the supporting arm abutting against the lower parturition wall.

7. The electrical connector as claimed in claim 6, wherein the lower partition walls define a set of parallel vertical surfaces so that the contacts could be vertically placed with respect to the lower housing before the upper housing is mounted upon the lower housing.

8. The electrical connector as claimed in claim 1, wherein the upper housing has a plurality of upper partition walls each having a upper guiding surface, the guiding surfaces being engaged with the elastic arm and varying in sequence so as to have the contacts slant with different angles of inclination in sequence.

9. The electrical connector as claimed in claim 1, wherein the upper housing has a plurality of upper partition walls, at least one of which has a height smaller than those of others.

10. The electrical connector as claimed in claim 1, wherein the contacts have substantially same structures with linear configurations.

11. An electrical connector, comprising:

a housing assembly comprising an upper housing defining a plurality of upper through holes and a lower housing defining a plurality of lower through holes, the upper through hole and corresponding lower through hole jointly constitute a passage way; and a plurality of contacts received in the passageways, respectively;

wherein each lower through holes of the lower housing define a plurality of positioning surfaces, having the contacts be arranged in parallel before the upper housing is mounted upon the lower housing, and when the upper housing is assembled to the bottom housing along up to down direction, the upper holes of the upper housing define corresponding upper abutting surfaces engaged with the contacts and have the contacts deflect at different angles of inclination.

12. The electrical connector as claimed in claim 11, wherein each contact comprises an upper contacting portion and a lower contacting portion, the neighboring lower contacting portions defining a larger distance than that defined by corresponding neighboring upper contacting portions.

13. The electrical connector as claimed in claim 11, wherein the contact comprises an elastic arm with said upper contacting portion and lower contacting portion formed at two opposite ends thereof, and a supporting arm bended upwardly from the lower contacting portion and abutting against the positioning surface.

14. The electrical connector as claimed in claim 11, wherein the upper housing has a plurality of upper partition walls between neighboring upper through holes, at least one of which has a height smaller than those of others.

15. The electrical connector as claimed in claim 11, wherein the contacts have substantially same structures with linear configurations.

16. The electrical connector as claimed in claim 11, wherein top ends of some of the lower through holes are smaller than those of corresponding bottom ends.

17. An electrical connector comprising:

an upper housing unit and a lower housing unit arranged with each other in a vertical direction;

a plurality of upper through holes defined in the upper housing unit;

a plurality of lower through holes defined in the lower housing unit corresponding to the upper through holes, respectively, in a one-to-one relation;

a plurality of contacts each unitarily defining an upper section upwardly extending through the corresponding upper through hole with thereof an upper end above an upper face of the upper housing unit and a lower section downwardly extending through the corresponding lower through hole and with thereof a lower end below a bottom face of the lower housing unit under condition that the upper ends of the upper sections define a pitch which is smaller than that defined by the lower ends of the lower sections; wherein said contacts are essentially similar to one another while arranged in the corresponding upper through holes and lower through holes with different but gradual angled manner.

18. The electrical connector as claimed in claim 17, wherein each of said upper through hole and the corresponding lower through hole defines an oblique face to support the corresponding contact.

19. The electrical connector as claimed in claim 17, wherein upper openings of said upper through holes in the upper face of the upper housing unit are essentially dimensioned similar to one another while bottom openings of the upper through holes in a bottom face of the upper housing unit are dimensioned in a gradually increasing manner.

20. The electrical connector as claimed in claim 17, wherein upper openings of the lower through holes in an upper face of the lower housing unit are essentially dimensioned similar to each other while bottom openings of the lower through holes in the bottom face of the lower housing unit are dimensioned in a gradually increasing manner.

* * * * *